US009596952B2

(12) United States Patent
Mencel

(10) Patent No.: US 9,596,952 B2
(45) Date of Patent: Mar. 21, 2017

(54) SECURED RECEIVING ARRANGEMENT FOR A DELIVERED PARCEL

(71) Applicant: Carl Joseph Mencel, South Australia (AU)

(72) Inventor: Carl Joseph Mencel, South Australia (AU)

( * ) Notice: Subject to any disclaimer, the term of this patent is extended or adjusted under 35 U.S.C. 154(b) by 0 days.

(21) Appl. No.: 15/136,179

(22) Filed: Apr. 22, 2016

(65) Prior Publication Data

US 2016/0309939 A1 Oct. 27, 2016

(30) Foreign Application Priority Data

Apr. 27, 2015 (AU) ..... 2015901498

(51) Int. Cl.
*A47G 29/20* (2006.01)
*A47G 29/30* (2006.01)
*A47G 29/14* (2006.01)

(52) U.S. Cl.
CPC ..... *A47G 29/20* (2013.01); *A47G 29/30* (2013.01); *A47G 2029/144* (2013.01)

(58) Field of Classification Search
CPC .. A47G 29/20; A47G 29/30; A47G 2029/144; A47G 29/124; A47G 29/122; E05G 1/005; B65D 7/32
USPC ..... 232/17, 19, 45, 22, 23; 109/50; 70/63; 340/569; 220/4.34
See application file for complete search history.

(56) References Cited

U.S. PATENT DOCUMENTS 4,275,829 A * 6/1981 Johnson ..... A47G 29/1209 220/4.34
4,694,668 A * 9/1987 Ciletti ..... A47G 29/20 109/50
4,909,052 A * 3/1990 Hutwohl ..... A47G 29/20 109/50
5,150,834 A * 9/1992 Bourke ..... A47G 29/1203 232/1 C
5,624,071 A * 4/1997 Sosan ..... A47G 29/20 232/1 B
5,774,053 A * 6/1998 Porter ..... A47G 29/141 232/19
5,845,843 A * 12/1998 Kuller ..... A47G 29/12 232/17
6,155,715 A * 12/2000 Lake ..... A47G 29/20 150/102
6,204,763 B1 * 3/2001 Sone ..... A47G 29/141 221/2

(Continued)

FOREIGN PATENT DOCUMENTS

JP 04096712 A * 3/1992

*Primary Examiner* — William Miller
(74) *Attorney, Agent, or Firm* — Renner Kenner Greive Bobak Taylor & Weber

(57) ABSTRACT

A secured receiving arrangement for a delivered parcel includes a parcel receptacle for the delivered parcel to be enclosed therein; a lock arrangement to lock and unlock the lid of the parcel receptacle; and a securing device to secure the parcel receptacle to a door at the property to where the delivered parcel is addressed. The securing device is attached at one end to the parcel receptacle and at the other end includes an abutment such that when the securing device is slid under the door and the door is then closed, unsecuring the parcel receptacle from the door is prevented by the abutment of the securing device engaging the internal side of the door.

15 Claims, 10 Drawing Sheets

(56) References Cited

U.S. PATENT DOCUMENTS

| | | | | |
|---|---|---|---|---|
| 7,175,071 | B1 * | 2/2007 | Slagle | A47G 29/16 220/833 |
| 7,182,244 | B2 * | 2/2007 | Brown | A47G 29/1209 220/651 |
| 8,358,199 | B2 * | 1/2013 | Nesling | 232/20 |
| 9,364,112 | B2 * | 6/2016 | Sundaresan | A47G 29/124 |

* cited by examiner

SECURED RECEIVING ARRANGEMENT FOR A DELIVERED PARCEL

FIELD OF THE INVENTION

This invention relates to an arrangement for the safe and secure handling of a delivered parcel to an address where at the time of delivery, the addressee or someone authorized on behalf of the addressee is not available to accept the parcel being delivered.

In particular this invention relates to a very unique secured receiving arrangement for delivering a parcel to an unattended address that includes a parcel receptacle that will be self-mountable and securable to a fixture of the address property, for the most part being door, gate or window without the requirement of any additional fastening means other than those inheritably incorporated as part of the parcel receptacle.

BACKGROUND OF THE INVENTION

Purchasing of tangible goods online requires that they be dispatched from the supplier to be delivered to a physical address to be enjoyed by the purchaser. Goods that are purchased in more conventional retail stores for which under various circumstances may not automatically be available at time of purchase within the store are also subsequently required to be delivered to the customers address once the goods become available.

For the most part the delivering of purchased goods generally has the product appropriately safely packaged within a parcel format where it is then delivered to the recipients address.

The problem is however is that most parcels are of a size to which a standard home's letter box is not able to accommodate.

This means that if the recipient of the delivered goods is not present at the property at the time of the delivery, the delivery person has no alternative than to either leave the parcel unsecured at the property or alternatively return the parcel to the delivery agent's storage facility for the collection by the intended recipient at a later time, thus removing the convenience of home delivery and adding additional burden to the intended recipient of having to travel to the storage facility to ultimately take receipt of the parcel that had hitherto been delivered to the appropriate address when the address was unattended.

While it is potentially possible to encourage property owners to install larger, permanently secured letter-boxes to accommodate parcels of greater size, this approach in itself brings forth its own design problems wherein it may become unsightly or difficult to construct at the receivable point of the property, a large securable letter-box type structure.

Rather than installing a costly permanent secured letter-box, it would be far more advantageous if there was some way in which that the recipient could rely upon a more mobile or portable arrangement that could be conveniently fixed at a receivable point of the property when required and then removed during those times when parcel delivery has not been scheduled to the address or someone is home to receive the parcel.

Accordingly, it is an object of this invention to provide for a secured receiving arrangement for a delivered parcel when the intended recipient of the delivered parcel is not present at the address at the time of delivery of the parcel.

Further objects and advantages of the invention will become apparent from a complete reading of the following specifications.

Before introducing the summary of the invention and then preferred embodiments of the invention thereafter, the invention is described and defined for the most part wherein the secured receiving arrangement for the delivery parcel involving the parcel receptacle is secured to a door at the address to where the parcel is to be delivered.

While reference is made to a door the definition of the door in the context of this invention would include other similar property fixtures including a gate, a window, sliding doors, existing letterbox and the like. Accordingly, referencing to the word door should be synonymously interpreted as also correspondingly defining and describing these additional type property fixtures.

Also general referencing to the door and the synonymous features listed, would be of a type that are lockable and/or securable. Hence in the context of the applications of the arrangement described and defined in this specification those general referencing to the door and the synonymous features listed, would be ones that are lockable and/or securable.

SUMMARY OF THE INVENTION

In one form of the invention there is provided a secured receiving arrangement for a delivered parcel, said secured receiving arrangement including:

a parcel receptacle including a hinged lid, wherein the hinged lid includes an open position wherein an internal chamber of the parcel receptacle becomes accessible for a delivered parcel to be enclosed therein, and wherein the hinged lid of the parcel receptacle further includes a locked position wherein the internal chamber of the parcel receptacle removes external access from a delivered parcel enclosed therein said parcel receptacle;

a lock arrangement adapted to lock the lid of the parcel receptacle into a lock position when the lid of the receptacle is closed and wherein the lock arrangement is further adapted to unlock the lid from the lock position to an open position;

a securing device adapted to secure the parcel receptacle to a door at a property to where the delivered parcel is addressed, wherein the securing device includes a first distal end fixed to the parcel receptacle and a second distal end, wherein the second distal end includes an abutment, wherein the abutment is adapted to engage an internal side of the door to which the parcel receptacle is securable thereto, said securing device further including an intermediate length between the first distal end and the second distal end, wherein the intermediate length is comparable to a depth of the door to which the parcel receptacle is securable thereto, such that when the securing device is slid under a bottom rail or edge of the door to which the parcel receptacle is securable thereto and the door is closed within a corresponding door frame un-securing the parcel receptacle from the door to which the parcel receptacle is securable thereto is prevented by the abutment of the securing device engaging the internal side of the door.

In preference the securing device is fixed to the parcel receptacle by a pivot arrangement.

In preference the pivot arrangement includes a rod configured at or towards a bottom edge of a rear side of the parcel receptacle.

In preference the first distal end of the securing device includes a loop wherein the loop of the securing device is supported by the rod configured at or towards the bottom edge of the rear side of the parcel receptacle.

In preference the securing device is pivotally rotatable from an extended position, wherein the extended position allows the securing device to be slid under the bottom rail or edge of the door.

In preference the rear side of the parcel receptacle includes a slot, wherein the slot is configured to internally receive the abutment of the second distal end of the securing device, when said securing device is in a retracted position.

In preference the securing device is a single strip including a loop at the first distal end and a larger loop at the second distal end.

In preference the securing device strip is made of metal.

In preference the loop of the second distal end of the securing device is configured to receive a shackle of a pad lock so as to pad lock the securing device to a fixture at the address of the delivered parcel.

In preference the fixture is a gate.

In relation to the securing device and the preferred embodiments for the configurations of the securing device referenced above, this invention in its broadest scope is not restricted in any way to the use of the metal strip or the loop shape of either or both of the distal ends of the securing device. The abutment can be of any shape to functionally work.

What is essential to this invention is use of the securing device, which at one distal end is fixable to the parcel receptacle and the other end provides for an abutment and wherein the intermediate length between these distal ends allows the securing device to slide under the bottom rail or edge of the door when the door is open so as to position the parcel receptacle in place at the foot of the door so that once the door is closed the parcel receptacle then comes securely mounted or fixed to the door at the property where the parcel is to be delivered thereto.

Uniquely the design of this securing device allows for the parcel receptacle to be mounted and securely held by the door without any requirement for additional fastening features.

The parcel receptacle can be conveniently put into position when a delivery is scheduled and when the task has been completed the parcel receptacle can be conveniently withdrawn to be used on another day and if necessary at a separate location.

In preference the rear side of the parcel receptacle includes a raised shoulder, wherein the raised shoulder defines a passage way to support a rod to which said rod supports the lid of the parcel receptacle in a hinged arrangement between the open position and the lock position.

Advantageously the use of the raised shoulder on the rear side of the parcel receptacle means that the rear side of the parcel receptacle can be positioned closed up to the external side of the door so there is no gap that otherwise would have been required for a more conventional hinged arrangement that would have the support for the hinge protruding laterally out from the top edge of the rear side of the parcel receptacle.

Advantageously by being able to limit any distance between the rear side of the parcel receptacle and the external face of the door to which the parcel receptacle has been secured and mounted therewith assists in preventing tampering to try and dislodge of the parcel receptacle from the door, thereby adding further inherent anti-theft functionality to the parcel receptacle.

In preference a front side, left side, right side and or the rear side of the parcel receptacle includes grooves and/or slots to provide a user grip-able handle.

In preference the lock arrangement includes a latch and a latch striker.

In preference the latch striker is included on an underside of the lid to engage a latch fixed on an internal surface of a corresponding front side, left side or right side of the parcel receptacle.

In preference the lock arrangement includes a key, code or combination pad and or an electronic activate-able switch to unlock the latch striker from the latch when the lid is in the lock position.

In preference the latch is a rotary latch, wherein the rotary latch is able to be activated by a parcel delivery person upon pushing the lid to the lock position after the parcel delivery person encloses the delivered parcel into the internal chamber of the parcel receptacle.

Further description of the locking arrangement will be discussed when referencing the preferred embodiment of the invention shortly hereafter but it needs to be recognized that the locking arrangement of the invention is not restricted to any one particular locking embodiment.

In preference an intermediate width of the securing device will be wider than the intermediate length thickness.

In the preferred embodiments the thickness of the intermediate length of the securing device will be limited to allow for insertion along gaps at the bottom rail or edge of the door.

As expected the thickness of the intermediate length will be limited to allow for insertion under typical door and the like at the property wherein the width of the intermediate length of the securing device and the abutment at the second distal end will be at least enough to prevent the securing device from being rotated into the gap under the edge of the door along the longitudinal axis thereby preventing the abutment section of the securing device from being withdrawn back under the door away from the secured installed position with the door.

In an alternative embodiment of the invention the intermediate length of the securing device includes a chained section wherein the chain section connects to the first distal end and the second distal end of the securing device.

Further alternative embodiments of the intermediate length of the securing device can include stranded wire rope, cabling or metallic braided wire.

In preference the underside of the parcel receptacle includes raised rounded contour extensions to facilitate sliding of the parcel receptacle over typical surfaces expected to be at the delivery address adjacent to the gap made available under the bottom rail or edge of the door, wherein the raised contoured and rounded sections will assist the parcel receptacle sliding over the flooring surface and threshold when closing and opening the door when the parcel receptacle is engaged with the door.

In preference the parcel receptacle further includes ground engaging wheels or rollers attached to the underside of the parcel receptacle to assist the parcel receptacle to slide over a flooring surface and threshold when closing and opening the door to which parcel receptacle is attached.

In preference the parcel receptacle is an assembly formed from an underside panel, rear side panel, left side panel, right side panel and lid.

In preference each underside panel, rear side panel, left side panel and right side panel includes a plurality of edge-connected tabs, configured to accept connector pins to form a joint between each underside panel, rear side panel, left side panel and right side panel.

The connector pins will preferably be made from metal, however other materials could be used.

In preference the secured receiving arrangement for the delivered parcel further includes an alarm device.

In preference the alarm device can transmit a signal to a remote alarm system or monitoring system installed at the property of the delivery address or elsewhere.

Preferably the alarm device can be self-contained and attached to the parcel receptacle.

The device will be armed when the closing of the lid of the parcel receptacle following the delivery of a parcel and will be dis-armed when the parcel receptacle is unlocked.

Preferably the alarm device will be triggered by a tampering action from a tilt switch, or a motion switch, or a proximity switch, or an acceleration switch, or a combination of a set of switches, attached to the parcel receptacle.

In order now to describe the invention in greater detail a preferred embodiment will be presented of this secured receiving arrangement for a delivered parcel in the following illustrations and accompanying text.

DETAIL DESCRIPTION OF THE INVENTION

Figure 1:
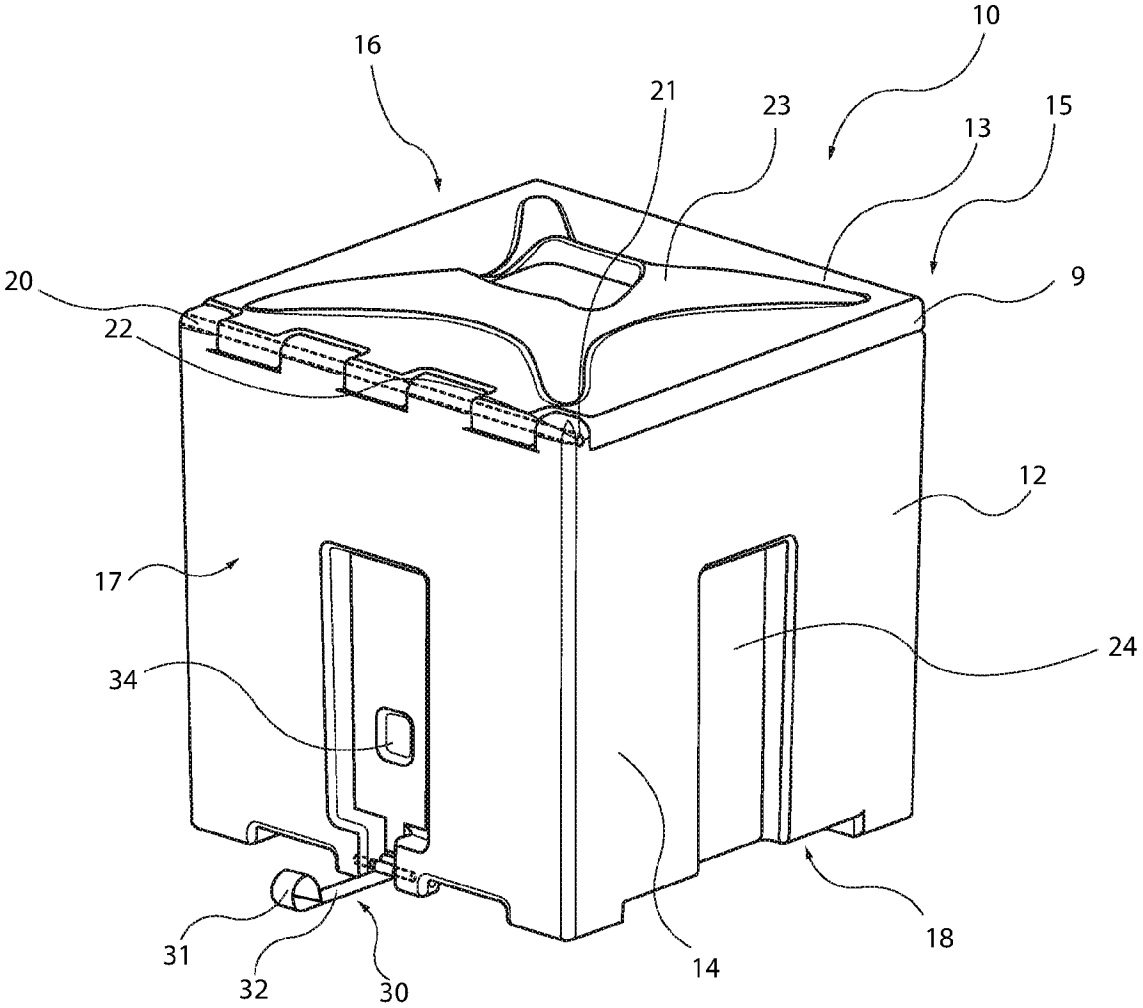
FIG. 1 is a perspective view of the secured receiving arrangement for a delivered parcel in a preferred embodiment of the invention.

The secured receiving arrangement for a delivered parcel to be dispatched to a recipient's address when at the time of the delivery the intended recipient or other authorized on behalf of the recipient are not present to accept the delivery the parcel, is shown generally as 10.

The secured receiving arrangement for the delivered parcel 10 includes a parcel receptacle shown as 12.

The parcel receptacle 12 includes a lid 9 with a top surface 13, a front side 15, a right hand side 16, a left hand side 14, and a rear side 17.

The underside of the parcel receptacle 12 is also shown by way of arrow 18.

The rear side 17 also includes a raised shoulder 21 which defines a passage way shown by way of 22 to which a rod 20, represented by broken lines, allows the lid 9 to be hinged opened and closed.

In the embodiment shown there is a raised generally star shaped configuration 23 on the top surface 13 of the lid 9 which while also providing aesthetics to the overall representation of the parcel receptacle 12, the generally star shaped configuration 23 also functions as reinforcing the stiffness and durability of the parcel receptacle 12 and also discourages things being put on the top surface 13 of the lid 9 and/or having people unnecessarily sitting or stepping on the lid 9 of the parcel receptacle 12.

While not shown in the preferred embodiment referenced in the illustrations the underside 18 of the parcel receptacle 12 can also include additional features such as wheels, rollers, raised contour edges and the like that can assist in sliding the parcel receptacle 12 into position over presented surfaces adjacent to the door and gap to where the parcel receptacle 12 will be secured.

Figure 2:
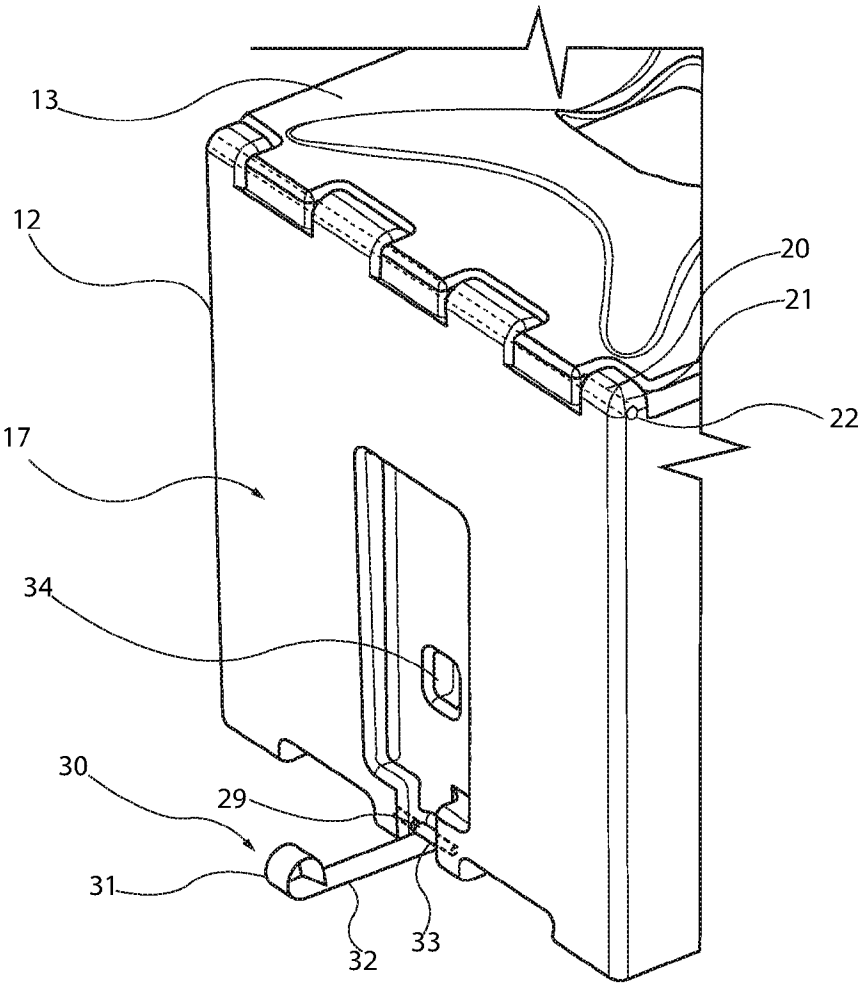
FIG. 2 is a part exploded perspective view of the rear side of the secured receiving arrangement for a delivered parcel in a preferred embodiment of the invention.
Figure 3:
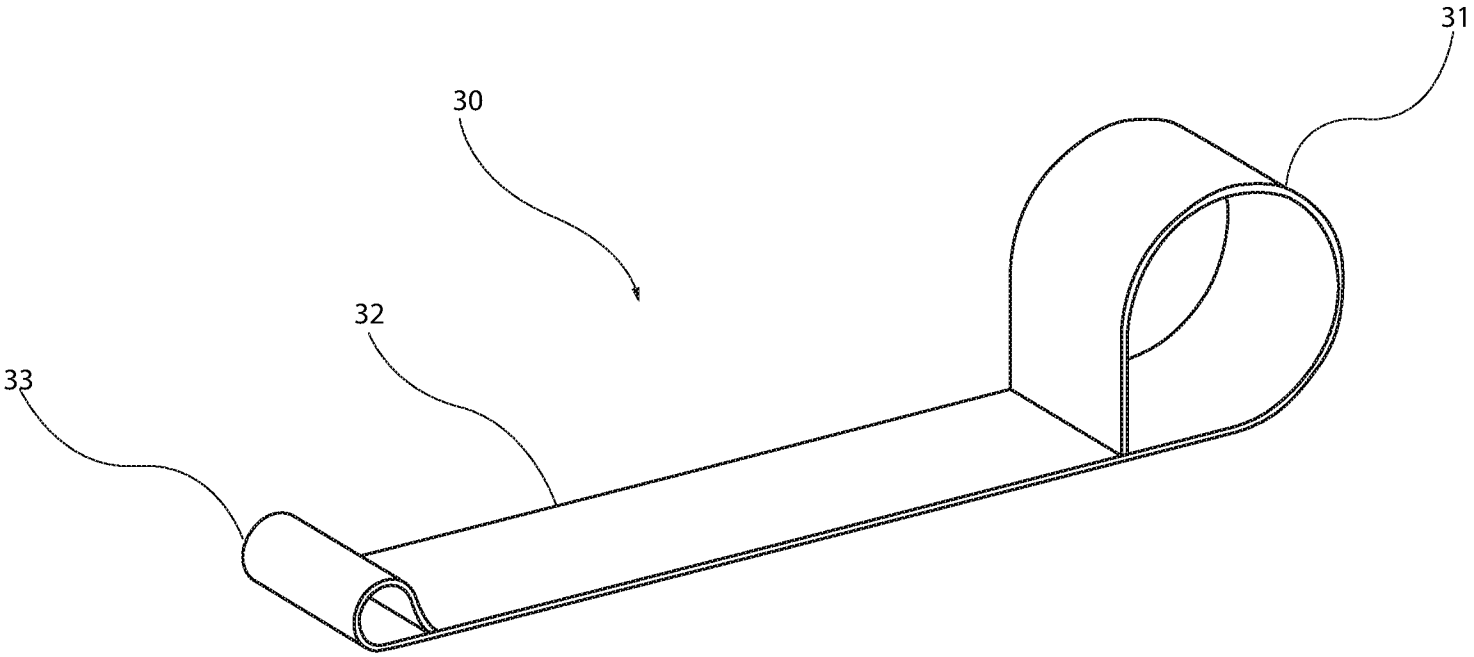
FIG. 3 is perspective view of the securing device of the secured receiving arrangement for a delivered parcel in a preferred embodiment of the invention.

As best seen in FIG. 2 pivotally attached to the parcel receptacle 12 is the securing device shown as 30 in FIG. 2 and then represented independently in FIG. 3 also generally as 30.

The securing device 30 includes a first distal end with a determination loop 33, which is pivotally supported on the rod shown by dashed lines 29 towards and/or at the bottom edge of the rear side 17 of the parcel receptacle 12.

At the second distal end is a larger loop 31 which in the preferred embodiment acts as the abutment, which will be discussed, in greater detail when referencing FIGS. 5(*a*) through to 5(*f*).

As the securing device 30 is pivotally supported by the loop 33 engagement with the supported rod 29 within the lower bottom edge of the parcel receptacle 12 means that the securing device 30 can be placed in its extended position, as shown in FIGS. 1 and 2, where it will be engage-able within the underside gap below the bottom edge or bottom rail of a door (not shown) and then be pivotally retractable to within the slot 34 configured into the rear side 17 of the parcel receptacle 12.

Figure 4:
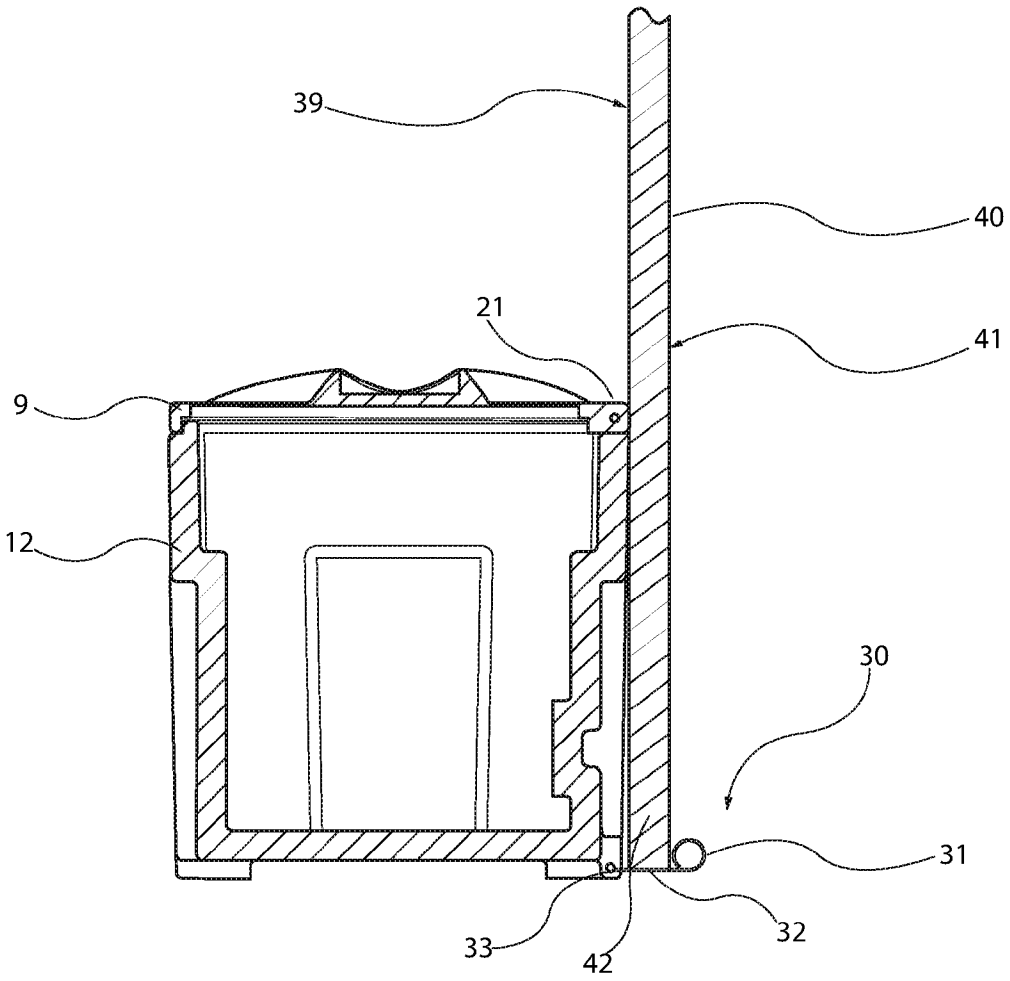
FIG. 4 is a cross sectional view of the secured receiving arrangement for a delivered parcel secured and mounted to a door in a preferred embodiment of the invention.

The securing device 30 includes the intermediate length 32 as best seen in FIG. 3, which would be commensurate in length to the dimensions of the depth 42 for the door 40 shown in FIG. 4.

This intermediate length 32 of the securing device 30 allows for the abutment member, which in the preferred embodiment is referenced as the loop 31 of the securing device 30 to engage the internal side 41 of the door 40 once the door 40 has been placed in the closed position, best seen in the cross-section view of FIG. 4.

The unique use of the raised shoulder 21 on the rear side 17 of the parcel receptacle 12 to provide the hinge arrangement to open and lock the lid 9 means that the rear side 17 of the parcel receptacle 12 is able to get close up to the front side 39 of the door 40 thereby removing any gaps which would assist with or could result in tampering or attempting to disengage the parcel receptacle 12 from its secured and mounted position with the door 40.

As introduced previously the thickness of the intermediate length 32 of the securing device 30 will be limited to allow for insertion under the bottom edge or railing of the door 40. The thickness and strength of the intermediate length 32 of the securing device 30 and the loop section 31 of the securing device 30 will at least be enough to prevent the securing device 30 from being rotated in the defined gap under the bottom edge or railing of the door 40 preventing the loop section 31 of the securing device 30 from being withdrawn out under the door 40 thereby preventing the disengagement of the parcel receptacle 12 from its secured mounted engagement with the door 40.

Referring to FIGS. 5(*a*) through to 5(*f*) wherein the parcel receptacle 12 by way of the extended securing device 30 is slid, shown by way of arrows 43, under the bottom edge or railing 45 of the door 40.

In FIG. 5(*b*) the door 40 is now closed looking from the inside of the property wherein the loop 31 of the securing device 30 is able to engage with the internal side 41 of the door 40 and shown by way of dashed lines is the parcel receptacle 12 being positioned on the outside 39 of the door 40.

FIG. 5(*c*) then shows the parcel receptacle 12 secured to the door 40 through the securing device 30 looking from the outside 39 of the door 40 with the lid 9 in an unlocked position.

Figure 5A:
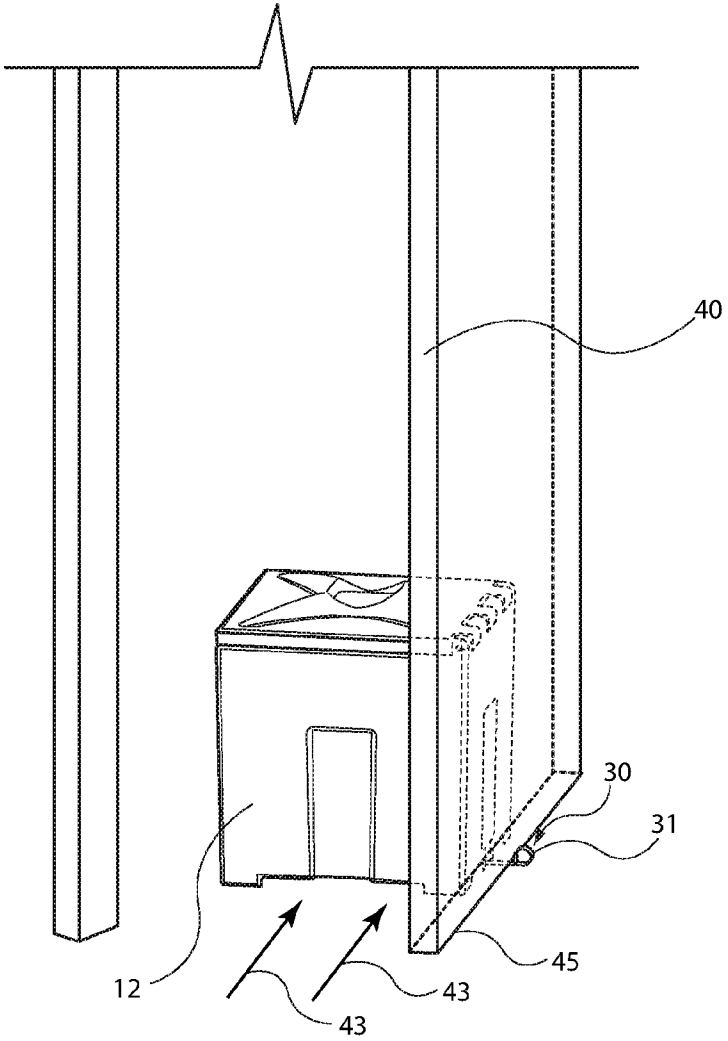
FIGS. 5(*a*) through to 5(*f*) are schematic representations of the steps and methods involved in the use of the secured receiving arrangement for a delivered parcel in a preferred embodiment of the invention.
Figure 5B:
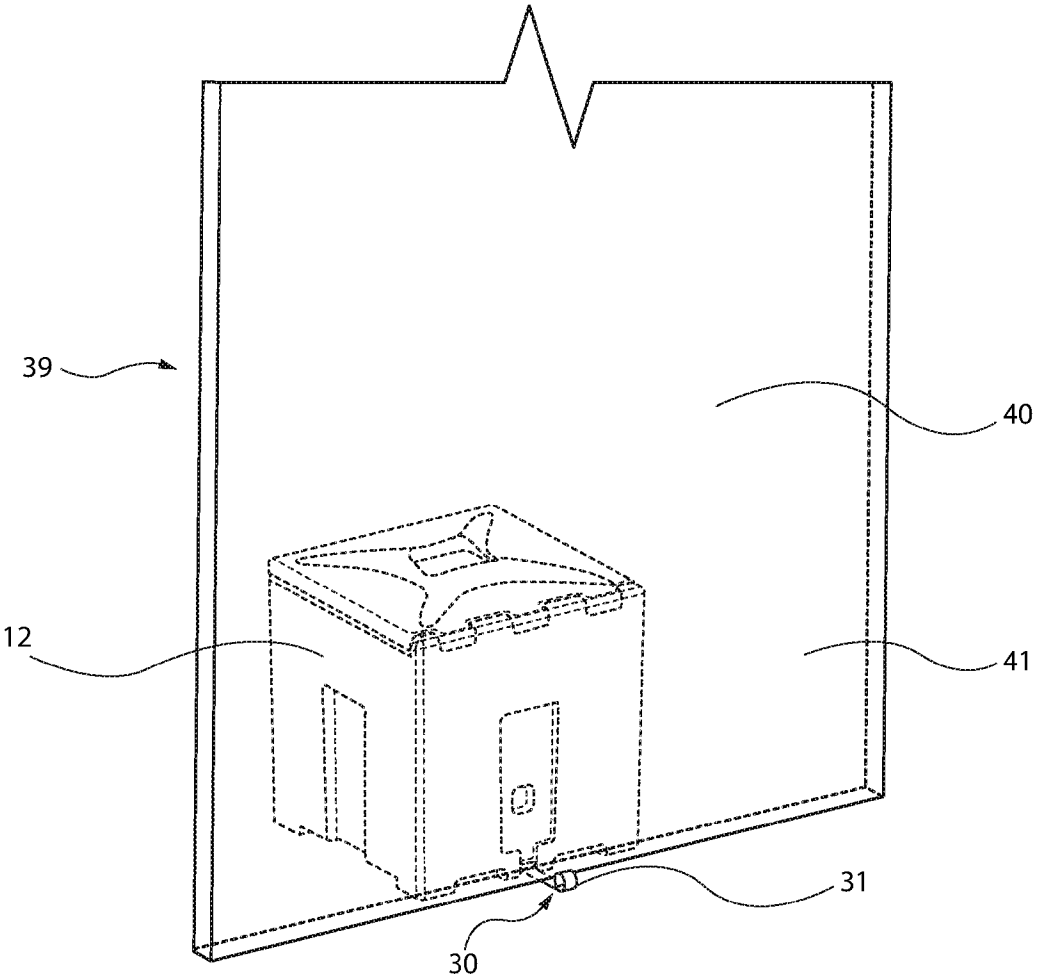
Figure 5C:
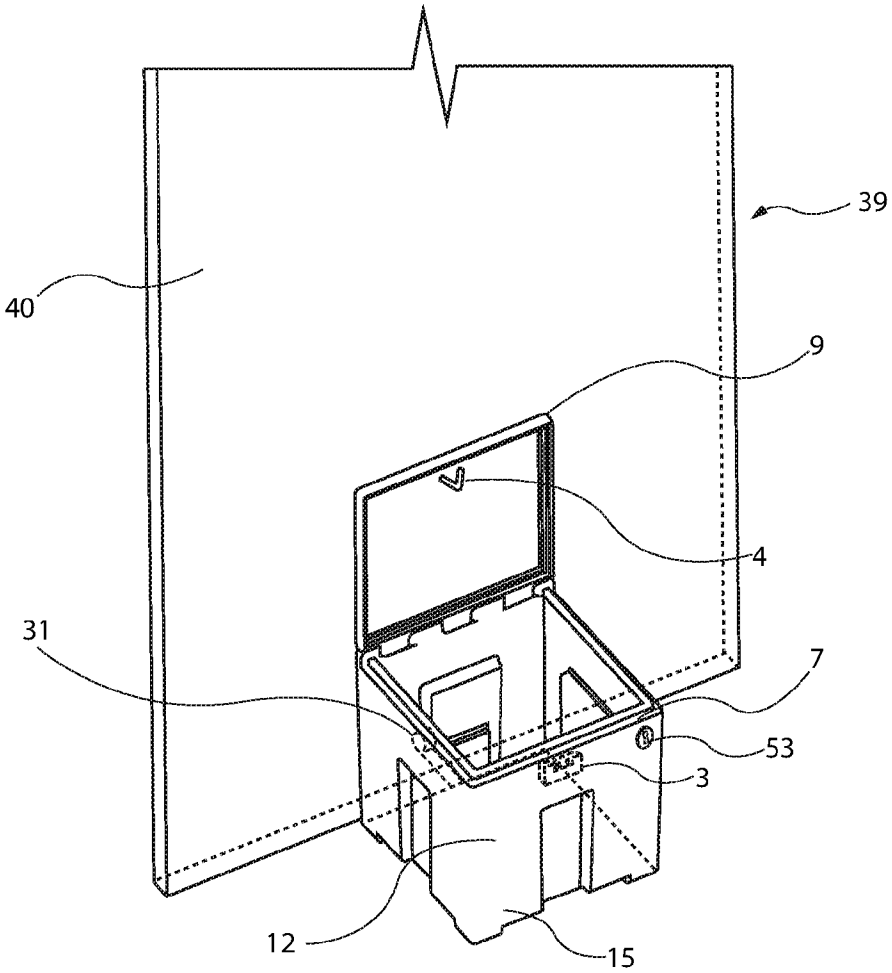
Figure 5D:
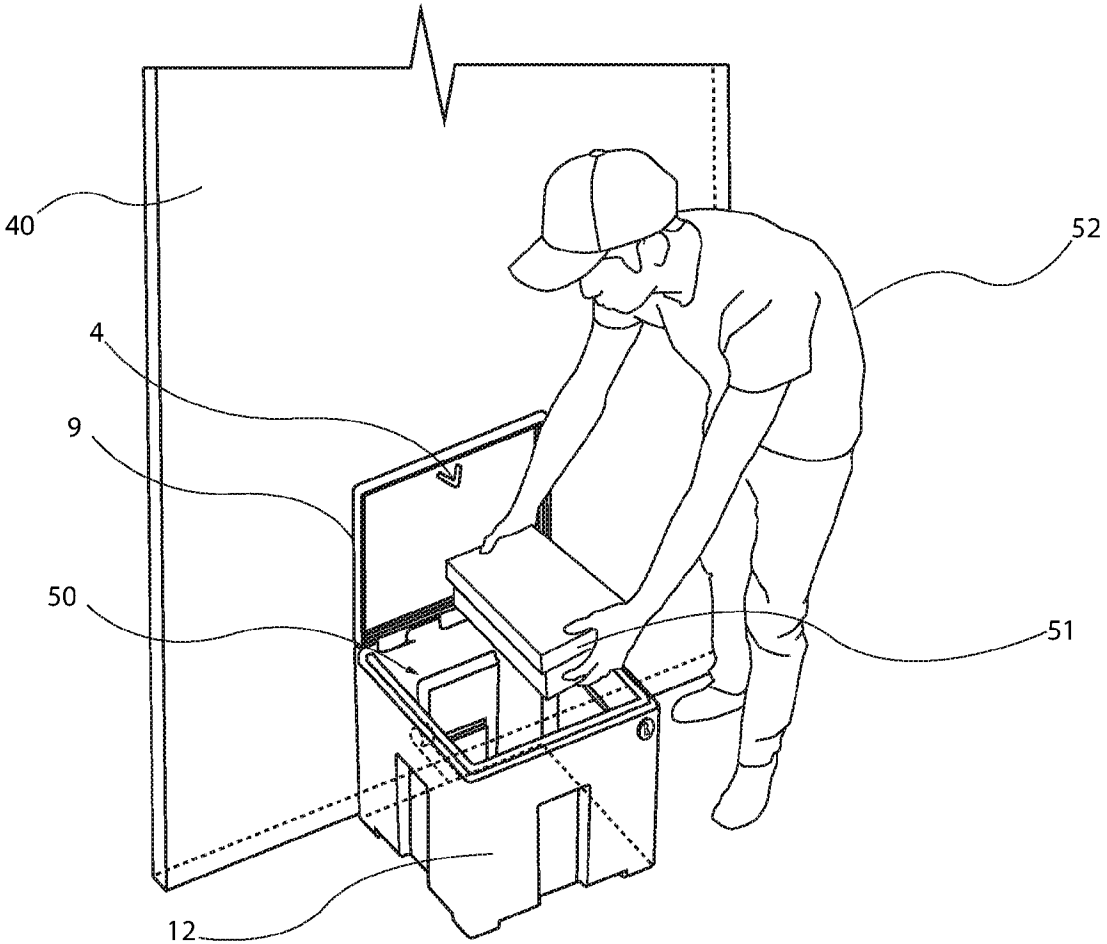
Figure 5E:
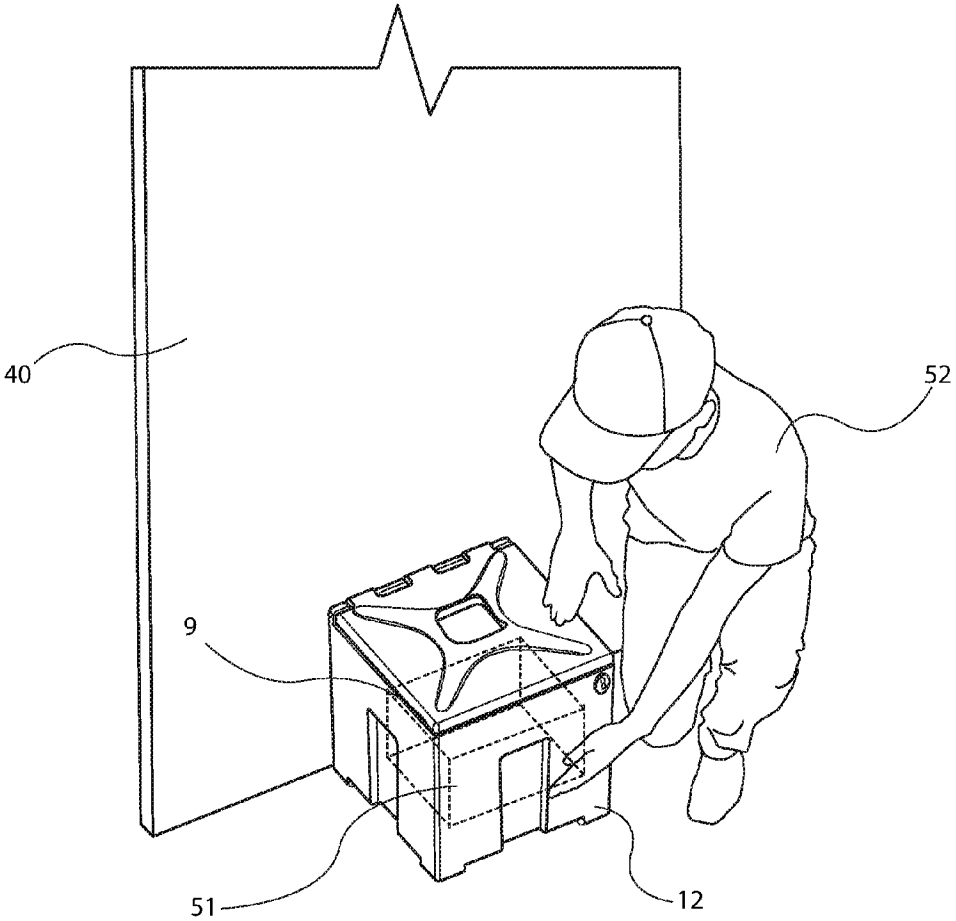
Figure 5F:
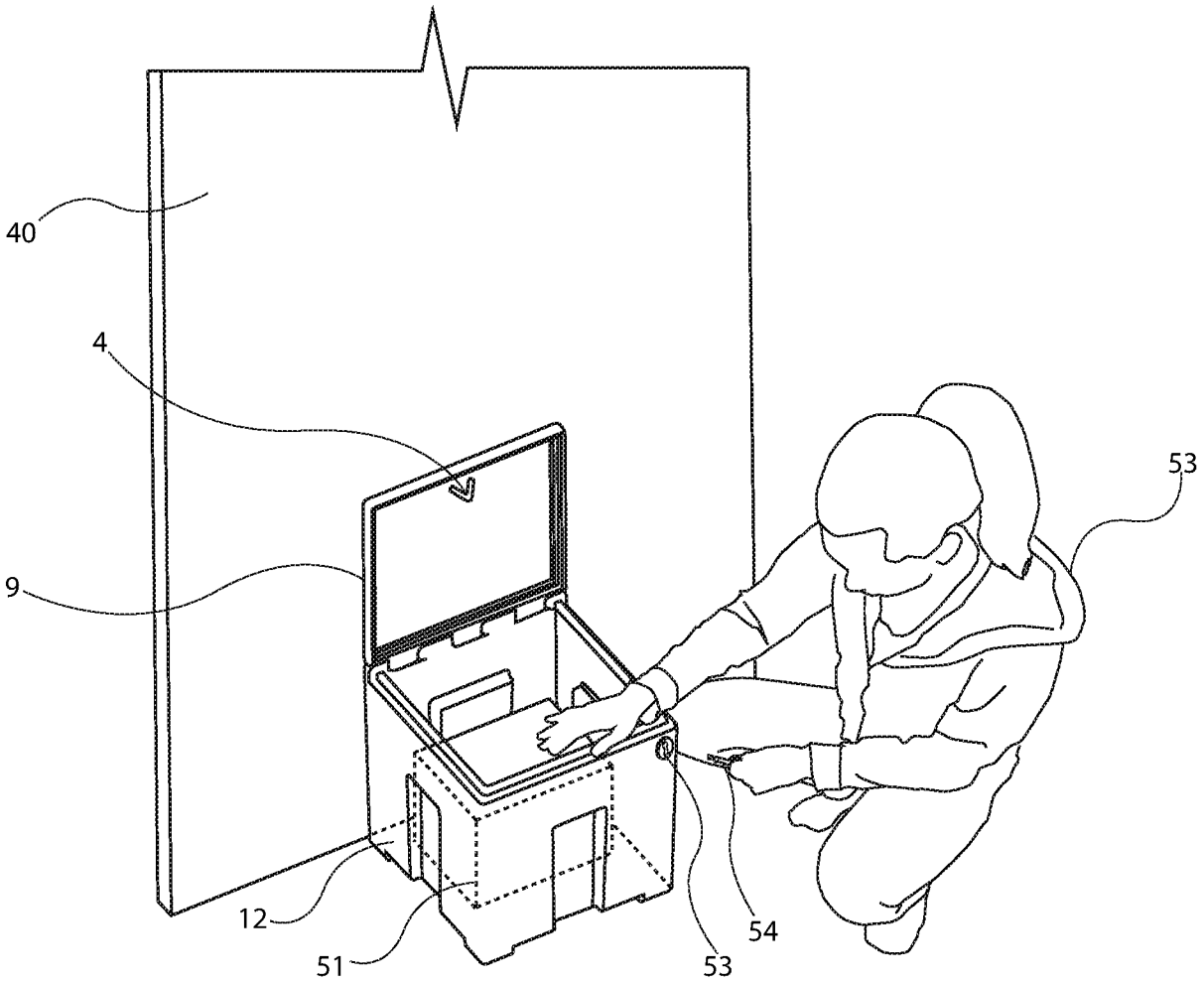

Though any general locking arrangement will work with this invention in the preferred embodiment, as best seen in FIG. 5*c*, the underside of the lid 9 includes a latch striker 4 wherein once the lid 9 is closed by the delivery person 52 referenced to in FIG. 5(*e*) the lid 9 becomes self locking in that the latch striker 4 included on the underside of the lid 9 engages with the latch 3 fixed within the parcel receptacle 12.

FIG. 5(*d*) illustrates the lid 9 in an open position to allow the delivery person 52 to place the delivered parcel 51 in the internal chamber 50 of the parcel receptacle 12.

In FIG. 5(*f*) represented by the key hole 53 and the associated key 54 of the authorized recipient 53, subsequent access to the parcel 51 enclosed within the parcel receptacle 12 is achieved through the key 54 inserted into the key hole 53 thereby triggering the latch 3 to disengage the latch striker 4 attached to the underside of the lid 9.

In the preferred embodiment shown the locking arrangement has been included on the front side 15 of the parcel receptacle 12 and wherein the corresponding latch striker 4 is included on the underside of the lid 9 above the front side 15 of the parcel receptacle 12.

The invention claimed is:

1. A secured receiving arrangement for a delivered parcel, said secured receiving arrangement including:

a parcel receptacle including a hinged lid, wherein the hinged lid includes an open position wherein an internal chamber of the parcel receptacle becomes accessible for a delivered parcel to be enclosed therein, and wherein the hinged lid of the parcel receptacle further includes a locked position wherein the internal chamber of the parcel receptacle removes external access from a delivered parcel enclosed therein said parcel receptacle;

a lock arrangement adapted to lock the lid of the parcel receptacle into the locked position when the lid of the receptacle is closed and wherein the lock arrangement is further adapted to unlock the lid from the locked position to the open position;

a securing device fixed to the parcel receptacle by a pivot arrangement and adapted to secure the parcel receptacle to a door at a property to where the delivered parcel is addressed, wherein the securing device includes a first distal end fixed to the parcel receptacle and a second distal end, wherein the second distal end includes an abutment, wherein the abutment is adapted to engage an internal side of the door to which the parcel receptacle is securable thereto, said securing device further including an intermediate length between the first distal end and the second distal end, wherein the intermediate length is comparable to a depth of the door to which the parcel receptacle is securable thereto, such that when the securing device is slid under a bottom rail or edge of the door to which the parcel receptacle is securable thereto and the door is closed within a corresponding door frame, un-securing the parcel receptacle from the door to which the parcel receptacle is securable thereto is prevented by the abutment of the securing device engaging the internal side of the door.

2. The secured receiving arrangement for a delivered parcel of claim 1 wherein the pivot arrangement includes a rod configured at or towards a bottom edge of a rear side of the parcel receptacle.

3. The secured receiving arrangement for a delivered parcel of claim 2 wherein the first distal end of the securing device includes a loop wherein the loop of the securing device is supported by the rod configured at or towards the bottom edge of the rear side of the parcel receptacle.

4. The secured receiving arrangement for a delivered parcel of claim 3 wherein the securing device is pivotally rotatable from an extended position, wherein the extended position allows the securing device to be slid under the bottom rail or edge of the door.

5. The secured receiving arrangement for a delivered parcel of claim 4 wherein the rear side of the parcel receptacle includes a slot, wherein the slot is configured to internally receive the abutment of the second distal end of the securing device, when said securing device is in a retracted position.

6. The secured receiving arrangement for a delivered parcel of claim 5 wherein the securing device is a single strip including a loop at the first distal end and a larger loop at the second distal end defining the abutment.

7. The secured receiving arrangement for a delivered parcel of claim 6 wherein the loop of the second distal end of the securing device is configured to receive a shackle of a pad lock so as to pad lock the securing device to a fixture at the address of the delivered parcel.

8. The secured receiving arrangement for a delivered parcel of claim 1 wherein a rear side of the parcel receptacle includes a raised shoulder, wherein the raised shoulder defines a passage way to support a rod to which said rod supports the lid of the parcel receptacle in a hinged arrangement between the open position and the lock position.

9. The secured receiving arrangement for a delivered parcel of claim 1 wherein a front side, left side, right side and or a rear side of the parcel receptacle includes grooves and/or slots to provide a user grip-able handle.

10. The secured receiving arrangement for a delivered parcel of claim 1 wherein the lock arrangement includes a latch and a latch striker.

11. The secured receiving arrangement for a delivered parcel of claim 10 wherein the latch striker is included on an underside of the lid to engage a latch fixed on an internal surface of the parcel receptacle.

12. The secured receiving arrangement for a delivered parcel of claim 11 wherein the lock arrangement includes a key, code and/or an electronic activate-able switch to unlock the latch striker from the latch when the lock arrangement is in the locked position.

13. The secured receiving arrangement for a delivered parcel of claim 1 wherein a width of the intermediate length will be greater than a thickness of the intermediate length.

14. The secured receiving arrangement for a delivered parcel of claim 1 wherein an underside of the parcel receptacle includes raised rounded contour extensions to facilitate sliding of the parcel receptacle over surfaces.

15. The secured receiving arrangement for a delivered parcel of claim 1 wherein the parcel receptacle is an assembly formed from an underside panel, rear side panel, left side panel, right side panel and the lid.

* * * * *